US005941312A

United States Patent [19]

Vermeeren

[11] Patent Number: 5,941,312

[45] Date of Patent: Aug. 24, 1999

[54] METHOD OF FABRICATING A ROD GUIDE, AND A ROD GUIDE/SUCKER ROD COMBINATION

[75] Inventor: Thomas Hubert Vermeeren, Spruce Grove, Canada

[73] Assignee: RG Industries Ltd., Calgary, Canada

[21] Appl. No.: 08/929,789

[22] Filed: Sep. 15, 1997

[51] Int. Cl.[6] ..... E21B 19/00; E21B 17/10

[52] U.S. Cl. ..... 166/378; 166/241.2

[58] Field of Search ..... 166/241.2, 241.3, 166/241.4, 241.6, 378; 175/325.1, 325.5

[56] References Cited

U.S. PATENT DOCUMENTS

| | | | |
|---|---|---|---|
| 2,247,564 | 7/1941 | Turner | 166/241.2 |
| 2,671,641 | 3/1954 | Hinkle | 175/325.5 |
| 2,690,934 | 10/1954 | Holcombe | 166/241.2 |
| 3,063,760 | 11/1962 | Gifford | 175/325.5 |
| 4,131,167 | 12/1978 | Richey | 175/325.5 X |
| 5,115,863 | 5/1992 | Olinger | 166/241 |
| 5,339,896 | 8/1994 | Hart et al. | 166/241 |
| 5,358,041 | 10/1994 | O'Hair | 166/241.4 |
| 5,740,862 | 4/1998 | Sable | 166/241.2 |
| 5,810,100 | 9/1998 | Samford | 166/241.3 X |
| 5,833,018 | 11/1998 | Von Gynz-Rekowski | 166/241.4 X |

FOREIGN PATENT DOCUMENTS

| | | | |
|---|---|---|---|
| 2101677 | 7/1993 | Canada | E21B 17/10 |
| 2173523 | 4/1996 | Canada | E21B 17/10 |

OTHER PUBLICATIONS

Brochure published May 1997 by Flow Control Equipment New Era & Patco Rod Guides.

*Primary Examiner*—Frank Tsay
*Attorney, Agent, or Firm*—Anthony R. Lambert

[57] ABSTRACT

A method of fabricating a rod guide. The first step involves providing a sucker rod having an exterior surface with a raised profile. The second step involves providing a split sleeve having at least one segment. The split sleeve has an interior surface with a recessed profile that mates with the raised profile of the sucker rod thereby securing the sleeve against axial movement relative to the sucker rod. The third step involves providing an overlying sleeve that overlies the split sleeve to maintain the split sleeve in mating engagement with the sucker rod.

11 Claims, 2 Drawing Sheets

METHOD OF FABRICATING A ROD GUIDE, AND A ROD GUIDE/SUCKER ROD COMBINATION

FIELD OF THE INVENTION

The present invention relates to a method of fabricating a rod guide and a rod guide/sucker rod combination suited, in particular, for use with a progressive cavity pump.

BACKGROUND OF THE INVENTION

Rod guides are intended to prevent a sucker rod which drives a downhole pump from rubbing against interior walls of the production tubing. U.S. Pat. No. 5,339,896 which issued to J. M. Huber Corporation in 1994 is representative of the type of rod guide currently in widespread use. The rod guide has a flexible body that is generally "C" shaped in cross-section. An elongate slot extends the length of the body, by means of which the guide is installed on a sucker rod. The width of the slot is less that the outer diameter of the sucker rod. During installation, the slot is expanded by flexing the flexible body to snap the body around the sucker rod. The body has a plurality of radial vanes which serve to centralize the sucker rod, while minimizing flow resistance around the guide. The body rides on the sucker rod between two stops which maintain axial positioning. Canadian Patent 2,101,677 by Sable which was published in 1994 discloses a rod guide with a more complex slot configuration. There is provided a body with two diametrically opposed longitudinal slots each of which extend half the length of the rod guide. A transverse slot connects the two longitudinal slots, by manipulating the body the rod guide can be snapped onto a sucker rod.

The rod guides, as described above, are experiencing problems with wear due to abrasion. Fine grains of sand and like particulate matter are working their way past the stops and getting between the rod guide and the sucker rod.

SUMMARY OF THE INVENTION

What is required is an alternate rod guide construction.

According to one aspect of the present invention there is provided a method of fabricating a rod guide. The first step involves providing a sucker rod having an exterior surface with a raised profile. The second step involves providing a split sleeve having at least one segment. The split sleeve has an interior surface with a recessed profile that mates with the raised profile of the sucker rod thereby securing the sleeve against axial movement relative to the sucker rod. The third step involves providing an overlying sleeve that overlies the split sleeve to maintain the split sleeve in mating engagement with the sucker rod. The overlying sleeve is secured to the split sleeve.

According to another aspect of the present invention there is provided a rod guide/sucker rod combination which includes a sucker rod having an exterior surface with a raised profile. A split sleeve is provided having at least one segment. The split sleeve has an interior surface with a recessed profile that mates with the raised profile of the sucker rod thereby securing the sleeve against axial movement relative to the sucker rod. An overlying sleeve overlies the split sleeve to maintain the split sleeve in mating engagement with the sucker rod. The overlying sleeve is secured to the split sleeve.

The rod guide/sucker rod combination, as described provides a number of advantages. Wear due to abrasion has been reduced, if not completely eliminated, by internalizing the axial stops. The rod guide/sucker rod combination is, therefore, much less likely to have fine grains of sand and like particulate matter work its way between the rod guide and the sucker rod. The rod guide is much less prone to separating from the sucker rod and falling down the well tubing. Fewer maintenance checks on the sucker rod and the rod guide are required.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
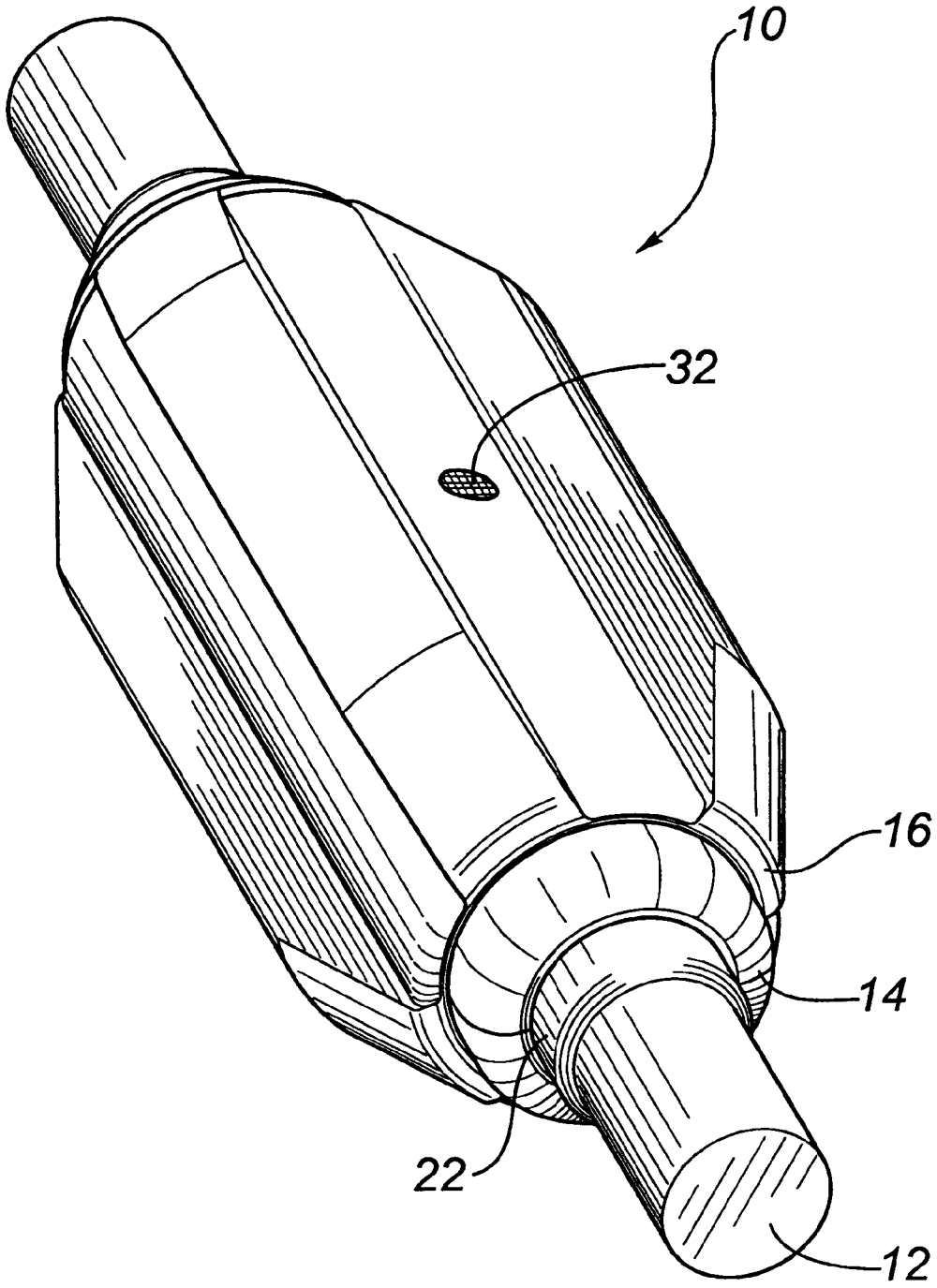
FIG. 1 is a perspective view of a rod guide/sucker rod combination fabricated in accordance with the teachings of the present invention.

The preferred embodiment, a rod guide/sucker rod combination generally identified by reference numeral 10, will now be described with reference to FIGS. 1 and 2.

Referring to FIG. 1, completed rod guide/sucker rod combination 10 has as components a sucker rod 12, split sleeve 14 and an overlying sleeve 16.

Figure 2:
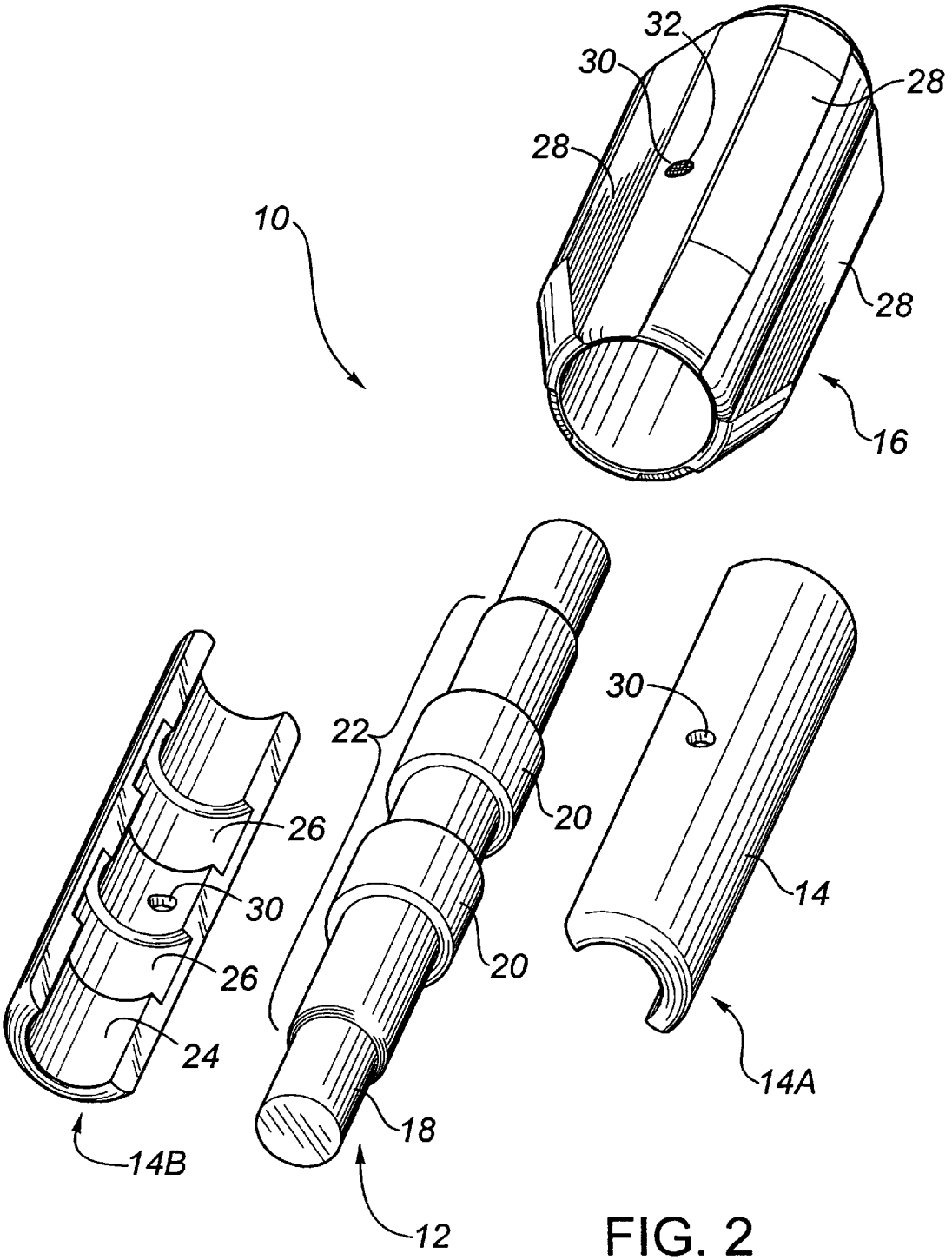
FIG. 2 is an exploded perspective view of a rod guide/sucker rod combination fabricated in accordance with the teachings of the present invention.

Referring to FIG. 2, the method of fabricating rod guide/sucker rod combination 10 involves the following steps. The first step involves providing a sucker rod 12 having an exterior surface 18 with a raised profile 20. As sucker rod 12 does not come with such a raised profile, raised profile 20 is, preferably, injection molded onto exterior surface 18 of sucker rod 12. The configuration illustrated shows injected molded portion 22, which forms raised annular profile 20. The second step involves providing split sleeve 14. Split sleeve 14, as illustrated consists of two segments 14*a* and 14*b*. Split sleeve 14 has an interior surface 24 with a recessed annular profile 26 that mates with raised annular profile 20 of sucker rod 12. As long as segments 14*a* and 14*b* are held together to maintain recessed annular profile 26 in engagement with raised annular profile 20, split sleeve 14 is secured against axial movement relative to sucker rod 12. Split sleeve 14 is preferably formed through an injection molding process. The third step involves providing an overlying sleeve 16 that overlies split sleeve 14 to maintain segments 14*a* and 14*b* of split sleeve 14 in mating engagement with sucker rod 12. Overlying sleeve 16 must be secured to split sleeve 14. It is preferred that overlying sleeve 16 be injection molded over split sleeve 14, in situ. Preferably overlying sleeve 16 has a plurality of exterior vanes 28. Once this step is completed rod guide/sucker rod combination 10 is ready to be taken and installed at a field location. Referring to FIG. 1, in order to promote improved fluid flow, it is preferred that injection moulded portion 22, split sleeve 14 and overlying sleeve 16 be staggered to give the ends a stepped or generally conical shape. If the materials used for moulded portion 22 and split sleeve 14 are not self lubricating, it may be advisable to provide a lubrication port 30 which extends through both overlying sleeve 16 and split sleeve 14. In order to prevent silt, sand and other abrasives from entering lubrication port 30, it may be advisable to position a filter element 32 in lubrication port 30.

It will be apparent to one skilled in the art that the component parts of rod guide/sucker rod combination 10 can be fabricated from any suitable material, such as nylon, polyethylene, polyphenylene sulfide, or polyphthalamide. It will also be apparent to one skilled in the art that any desired configuration of vanes 28. It will finally be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of fabricating a rod guide, comprising the steps of:

firstly, providing a sucker rod having an exterior surface with a raised profile;

secondly, providing a split sleeve having at least one segment, the split sleeve having an interior surface with a recessed profile that mates with the raised profile of the sucker rod thereby securing the sleeve against axial movement relative to the sucker rod; and thirdly, providing an overlying sleeve that overlies the split sleeve to maintain the split sleeve in mating engagement with the sucker rod, the overlying sleeve being secured to the split sleeve.

2. The method as defined in claim 1, further comprising the step of moulding the raised profile onto the exterior surface of the sucker rod.

3. The method as defined in claim 1, further comprising the step of moulding the overlying sleeve onto the split sleeve.

4. A rod guide/sucker rod combination, comprising:

a sucker rod having an exterior surface with a raised profile;

a split sleeve having at least one segment, the split sleeve having an interior surface with a recessed profile that mates with the raised profile of the sucker rod thereby securing the sleeve against axial movement relative to the sucker rod; and an overlying sleeve that overlies the split sleeve to maintain the split sleeve in mating engagement with the sucker rod, the overlying sleeve being secured to the split sleeve.

5. A method of fabricating a rod guide, comprising the steps of:

providing a sucker rod having an exterior surface;

moulding onto the exterior surface of the sucker rod a raised profile of polymer plastic;

providing a split sleeve having at least one segment, the split sleeve having an interior surface with a recessed profile that mates with the raised profile of the sucker rod thereby securing the sleeve against axial movement relative to the sucker rod while accommodating rotation of split sleeve relative to the sucker rod; and moulding, directly onto the split sleeve, an overlying sleeve of polymer plastic that overlies the split sleeve to maintain the split sleeve in mating engagement with the sucker rod, the overlying sleeve being secured to and rotatable with the split sleeve, the overlying sleeve having a plurality of axially extending vanes.

6. The rod guide/sucker rod combination as defined in claim 4, wherein the raised profile is made of polymer plastic.

7. The rod guide/sucker rod combination as defined in claim 4, wherein the overlying sleeve is made of polymer plastic.

8. The rod guide/sucker rod combination as defined in claim 4, wherein the split sleeve is rotatably secured to the sucker rod and the overlying sleeve is non-rotatably secured to the split sleeve.

9. The rod guide/sucker rod combination as defined in claim 4, wherein the overlying sleeve has a plurality of axially extending vanes.

10. The rod guide/sucker rod combination as defined in claim 4, wherein at least one lubrication port is provided through each of the overlying sleeve and the split sleeve.

11. The rod guide/sucker rod combination as defined in claim 10, wherein a filter element is positioned in the lubrication port to preclude the entry of particulate matter.

* * * * *